US005468153A

United States Patent [19]

Brown et al.

[11] Patent Number: 5,468,153

[45] Date of Patent: Nov. 21, 1995

[54] WIRELINE SWIVEL AND METHOD OF USE

[75] Inventors: Robert L. Brown; John D. Holodnak; Gene McBride; Demmie L. Mosley, all of Lafayette, La.

[73] Assignee: Drilling Measurements, Inc.

[21] Appl. No.: 168,816

[22] Filed: Dec. 15, 1993

[51] Int. Cl.[6] ..... H01R 39/00

[52] U.S. Cl. ..... 439/13; 439/840; 439/18

[58] Field of Search ..... 439/13, 18, 20–22, 439/23, 27, 29, 190, 191, 192, 194, 195, 201, 206, 840

[56] References Cited

U.S. PATENT DOCUMENTS

| | | | |
|---|---|---|---|
| 1,720,619 | 7/1929 | Baldwin | 439/27 |
| 1,873,042 | 8/1932 | Rohrdanz | 439/18 |
| 2,339,274 | 1/1944 | Kothny | 439/194 |
| 3,056,101 | 9/1962 | Bethke | 439/21 |
| 3,259,727 | 7/1966 | Casler | 439/29 X |
| 3,753,206 | 8/1973 | Busuttil et al. | 439/194 |

*Primary Examiner*—David L. Pirlot
*Attorney, Agent, or Firm*—Roy, Kiesel & Tucker

[57] ABSTRACT

A rotatable electrical connector or swivel is used in a substantially vertical subterranean portion of a drill string within a drill pipe. The swivel has an enclosed oil filled chamber having a first shaft concentrically mounted therein. The first shaft protrudes from the chamber and is electrically connected to one end of a wireline which is used for electrical connection between the surface and instruments located downhole. Within the interior of the oil filled chamber the first shaft is attached to a first member disposed within the complementary surface of a second member concentrically aligned with the first member. The second member includes a second shaft which protrudes from the oil filled chamber and is connected to the other end of the wireline. One of the two shafts is rotatably mounted in bearing within the chamber so that the complementary surfaces of the first and second members are in the relationship of a rotor and stator. Continuous, electrical contact between the rotor and stator surfaces are assured by placement of a plurality of berrylium copper wire spring wipers between the rotors and stators. The enclosure of the oil filled chamber, includes an elastic member which permits equalization of the internal oil pressure within the chamber with the external hydrostatic pressure of the drilling fluid or other fluid present in the drill pipe.

15 Claims, 3 Drawing Sheets

WIRELINE SWIVEL AND METHOD OF USE

BACKGROUND OF THE INVENTION

1. Field of the Invention

The present invention is in the field of equipment used for subterranean drilling. More particularly, the present invention is directed to a rotatable electric connector through which a wireline electrical cable may be connected from the surface to an instrument or several instruments located downhole, and which permits relative rotation of a lower portion of the cable relative to its upper portion. The present invention is also directed to an assembly of components which incorporate the rotatable electric connector, and to methods of conducting drilling and subterranean measuring operations with the use of the rotatable electric connector.

2. Brief Description of the Prior Art

As is well known, equipment used for lowering a drill bit into subterranean formations, while drilling for oil, gas, minerals or geothermal resources, includes a string of drill pipes and a bottom hole assembly containing the drill bit. The drill bit may be driven either from the surface by rotating the drill string with a rotary table or by a downhole motor which is driven by drilling mud fluid pumped from the surface. Because drilling at great depth below the surface is a technologically difficult and expensive operation but of great commercial importance, a large body of technology has developed in the prior art creating various methods and devices for the actual drilling operation, and also instrumentation and methods for conducting downhole measurements and for transmitting data to the surface. More particularly, it is important to know the actual underground location and direction of the bore hole even when nominally vertical drilling is intended. In "directional drilling" however, the bore hole is intentionally deviated from the vertical, and may even include horizontally disposed sections. Instrumentation which has developed in the prior art for measuring the direction (inclination, azimuth and "tool face" direction) of the advancing bore hole, as well as surveying an existing bore hole, includes electronic instruments (steering tools) which transmit data to the surface through a single conductor electric cable (wireline), and also instruments which transmit data to the surface through pressure pulses in the drilling mud fluid. In addition to such directional guidance instruments (steering tools) there are many other instruments used in connection with drilling or surveying which require transmission of data from the bore hole to the surface.

Whereas transmitting data from the bore hole to the surface through pressure pulses in the drilling mud fluid has its advantages, a principal drawback is that data transmission is slow, typically 1 bit per second (1 bps). Data transmission on a wireline cable connecting the downhole instrument with the surface is much faster, and enables data transmission rates as fast as 5,000 bits per second. Problems encountered in the prior art regarding downhole instruments which require a wireline are related to adding drill pipe to the drill string while the wireline is in position, and to rotating the drill string from the surface while the wireline is in position.

The former problem, (that of adding additional pipe to the drill string) has been more-or-less solved in the prior art by the so-called wet connector (also known in oil field parlance as a "wet stab"). The wet connector is an underwater mateable electrical connector device, which has a lower portion including an electrical connector of male pin configuration attached to the electrical cable or wireline leading downhole to whatever instrument or instruments are connected to the cable in a downhole position relative to the wet connector. The wet connector also includes an upper portion which has a female receptacle connector of complementary configuration matching the male pin and which is capable of forming an electrical connection therewith even under water or other fluid such as drilling mud. The upper (female) portion of the underwater mateable connector is electrically and mechanically connected to the wireline which leads to the surface. It is usually also attached to a weight bar disposed immediately above the upper portion and to a centralizer bar which tends to center the underwater mateable connector within the drill pipe. The underwater mateable connector is located beneath the surface, in a vertical or substantially vertical section of the drill string and its lower (male) portion is held there and kept from falling further downhole, by an interior ledge or shelf located in the drill pipe. The underwater mateable connector is used in accordance with the prior art to sever electrical connection and remove from the drill string that portion of the wireline which is attached to the male electrical connector and which leads to the surface. After a desired operation, such as addition of a drill pipe section, or rotation of the drill string is accomplished, the upper portion of the underwater mateable connector (wet connector) is lowered back into the drill string. There the female receptacle is positioned by the force of gravity upon the male pin of the lower portion, and electrical contact of the surface with the downhole instrument or instruments is reestablished. As it is known in the art and should be apparent from the description above, the underwater mateable connector of the prior art does not enable continuous rotation of the drill pipe from the surface while the wireline is connected all the way from the surface to the downhole instrument or instruments. Consequently, the prior art does not enable continuous transmission of data from downhole instrument or instruments to the surface on a wireline while the drill string is rotated continuously, or even for a short while, even though this would be highly desirable because of the high data transmission rate achievable on a wireline. Operations where this would be particularly advantageous include using a survey or steering tool, Γ ray counting tool, chlorine logging tool, electrical resistivity sensing tool, or using a tachometer for drill motor or weight-on-bit measuring tool. The inability of the prior art to continuously use a wireline for data transmission from downhole-to-surface is particularly disadvantageous when drilling or surveying bore holes with a horizontal portion or a portion having a large horizontal component. The present invention solves this problem, and provides a rotatable electrical connector which allows rotation of the drill pipe from the surface while a wireline (electrical cable) leading from the surface to downhole instrument or instruments remain in operational contact with the surface through the wireline.

SUMMARY OF THE INVENTION

It is an object of the present invention to provide equipment which in a subterranean drilling operation allows rotation of the drill string while a wireline remains operational, electrically connecting the surface with a downhole instrument or instruments.

It is another but related object of the present invention to permit high data transmission rates from a downhole instrument or instruments to the surface through an electrical cable while permitting rotation of the drill string.

It is still another but related object of the present invention to permit continuous data transmission to the surface through a wireline from instruments located in the well bore, such as surveying and steering, Γ ray counting, chlorine logging electrical resistivity sensing, weight-on-bit measuring tools, tachometer for a drill motor and the like, while also permitting rotation of the drill string.

The foregoing and other objects and advantages are attained by a rotatable electrical connector (swivel) to be used in a substantially vertical subterranean portion of a drill string within a drill pipe. The swivel has an enclosed oil filled chamber having a first shaft concentrically mounted therein. The first shaft protrudes from the chamber and is electrically connected to one end of a wireline which is used for electrical connection between the surface and instruments located downhole. Within the interior of the oil filled chamber the first shaft is attached to a first member disposed within the complementary surface of a second member concentrically aligned with the first member. The second member includes a second shaft which protrudes from the oil filled chamber and is connected to the other end of the wireline. One of the two shafts is rotatably mounted in bearing within the chamber so that the complementary surfaces of the first and second members are in the relationship of a rotor and stator. Continuous, electrical contact between the rotor and stator surfaces are assured by placement of a plurality of berrylium copper wire spring wipers between the rotors and stators. The enclosure of the oil filled chamber, includes an elastic member which permits equalization of the internal oil pressure within the chamber with the external hydrostatic pressure of the drilling fluid or other fluid present in the drill pipe. When the drill string is rotated from the surface, the lower portion of the wireline leading from the rotatable electrical connector to a downhole instrument rotates therewith, while the upper section of the wireline leading from the rotatable electrical connector to the surface remains stationary. Relative rotation occurs between the stator and rotor surfaces within the oil filled chamber, while the beryllium copper spring wire wipers maintain reliable electrical contact, suitable for higher speed data transmission on the wireline.

The features of the present invention can be best understood together with further objects and advantages by reference to the following description, taken in connection with the accompanying drawings, wherein like numerals indicate like parts.

DESCRIPTION OF THE PREFERRED EMBODIMENT

The following specification taken in conjunction with the drawings sets forth the preferred embodiment of the present invention. The embodiment of the invention disclosed herein is the best mode contemplated by the inventors for carrying out their invention, although it should be understood that various modifications can be accomplished within the parameters of the present invention.

Figure 1:
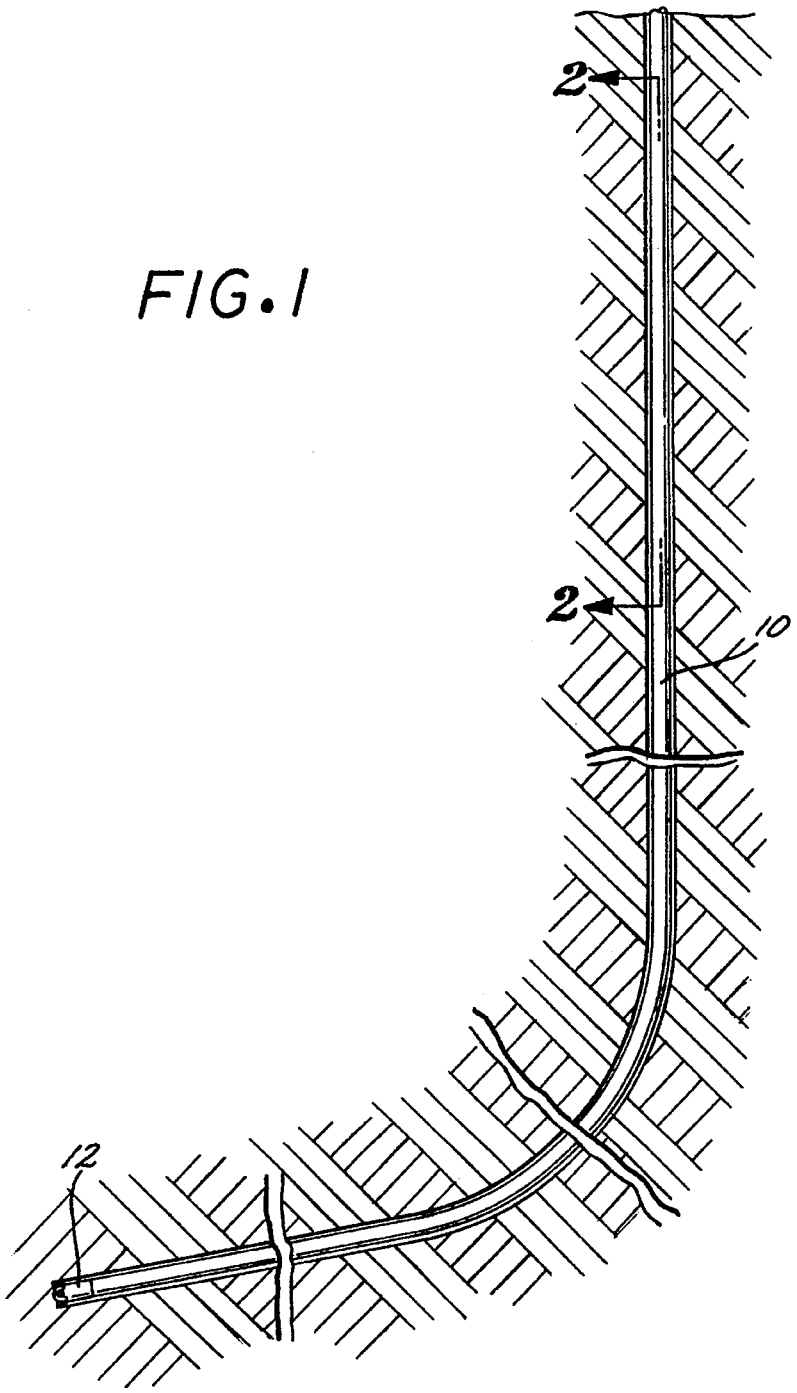
FIG. 1 is a schematic representation of a drill string.

Referring now to FIG. 1, a subterranean bore hole is shown schematically, which contains a drill string 10 lowered from the surface. Although the schematic view of FIG. 1 only shows a drill bit 12 at the bottom of the bore hole, it will be readily understood by those skilled in the art that a drilling motor and various instruments such as surveying and steering, Γ ray counting, chlorine logging electrical resistance sensing, weight-on-bit measuring tools, tachometer for a drill motor and the like, can be located within the bore hole. In the practice of the present invention these instruments are connected to the surface with a single conductor wireline 14 which is shown on FIG. 2. As is well known in the art on the surface the data are processed, displayed and or inputted into a computer in accordance with state-of-the-art. The wireline 14 itself is a standard, well known item in the trade relating to subterranean drilling, and may be obtained commercially, for example from The Rochester Corporation, Culpeper, Va.

As it will be readily understood by those skilled in the art, the drill string 10 is routinely rotated from the surface when drilling a nominally vertical bore hole. It is frequently desirable to rotate the drill string 10 from the surface even in "directional drilling" where a substantial deviation from the "vertical" is desired and a downhole drilling motor is used. The present invention is particularly suited for such situations in directional drilling where the drill string 10 needs to be rotated for one reason or another from the surface. As is noted in the introductory section of this patent application, an important objective of the present invention is to allow the wireline 14 to remain in the drill string 10 all the way from the downhole instrument or instruments (not shown) to the surface while the drill string 10 may be rotated from the surface. This enables continuous operation and high speed transmission of data from the downhole instrument or instruments (not shown) to the surface through the wireline 14. The transmission of data through the wireline 14 at an exemplary rate of approximately 2,000 to 5,000 bps is to be contrasted with data transmission at an exemplary rate of 1 bps through mud pulses, which is necessary in the prior art if downhole data are transmitted while the drill string 10 is rotated.

Figure 2:
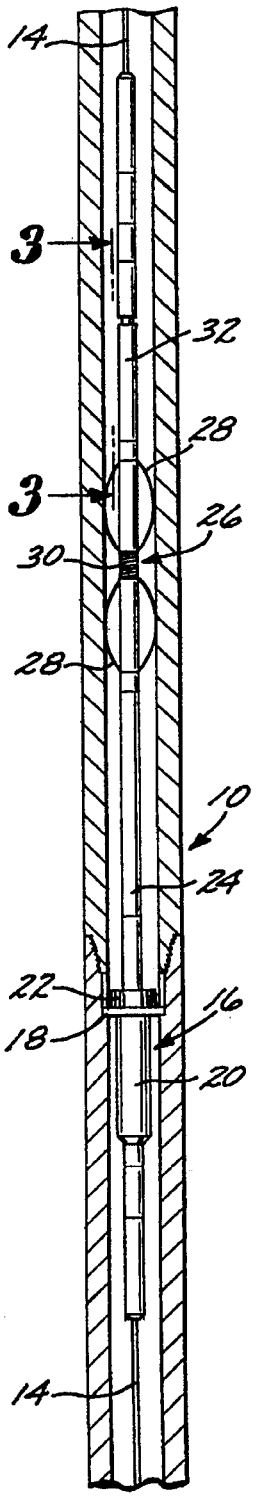
FIG. 2 is a schematic, cross-sectional view showing the portion of the drill string wherein the rotatable electrical connector of the present invention is incorporated, the cross-section being taken on lines 2,2 of FIG. 1.
Figure 3:
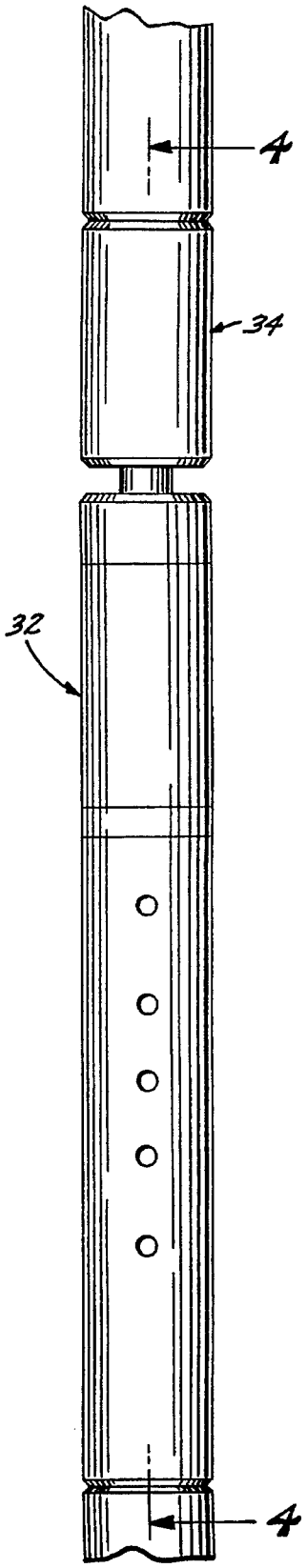
FIG. 3 is a front view of the rotatable electrical connector of the present invention.
Figure 4:
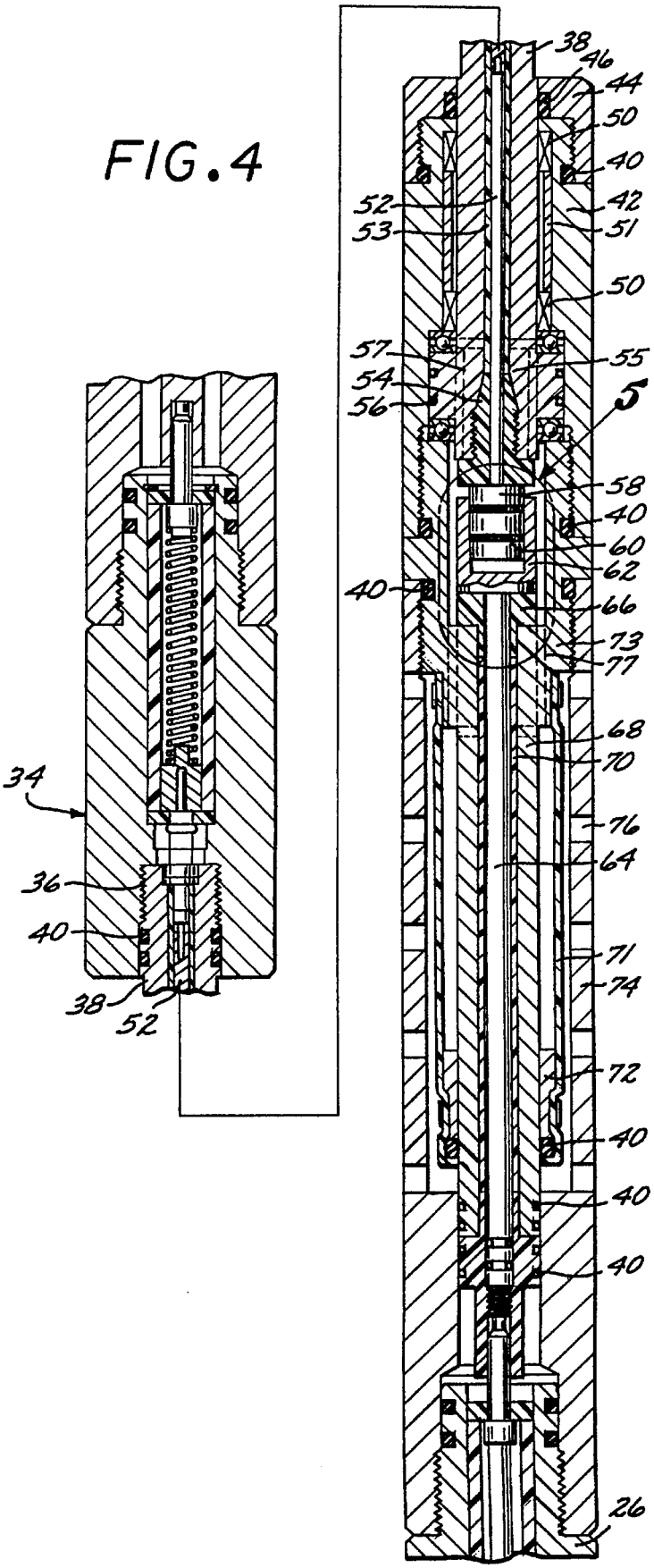
FIG. 4 is a cross-sectional view taken on lines 4,4 of FIG. 3.
Figure 5:
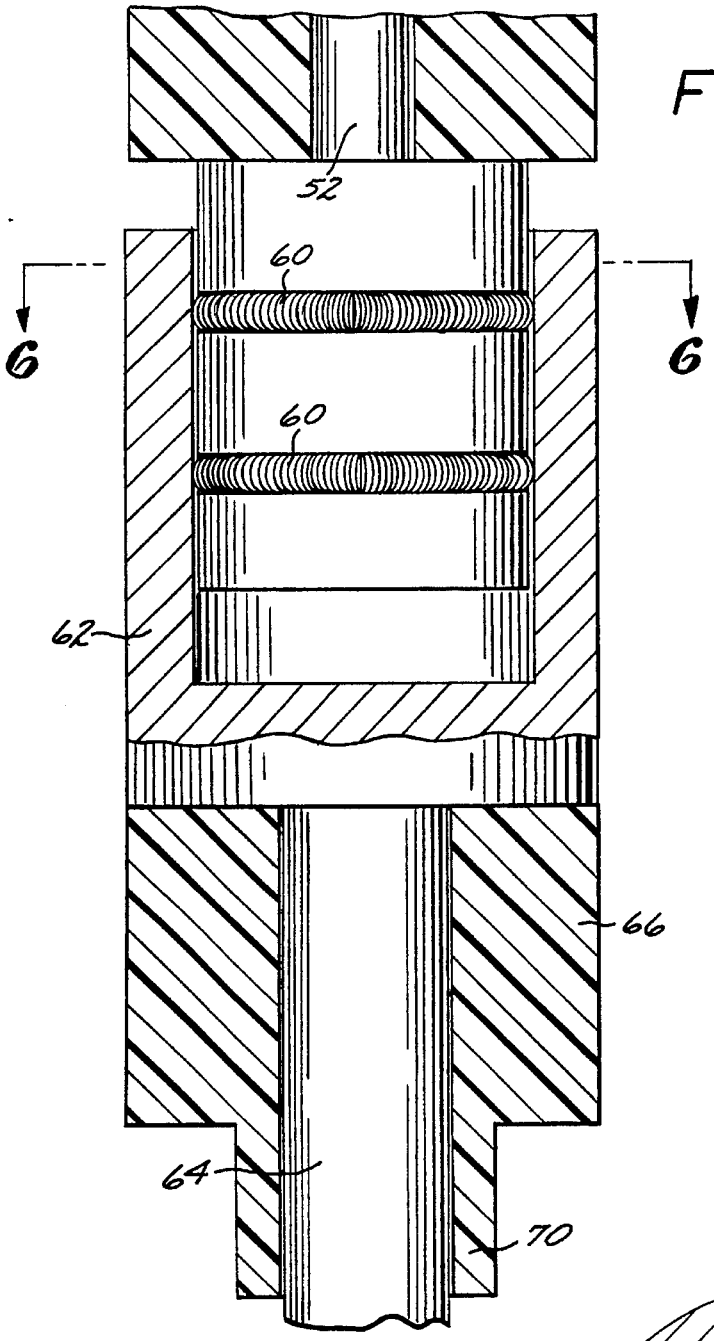
FIG. 5 is an enlarged cross-sectional view of the area indicated by the numeral 5 in FIG. 4.
Figure 6:
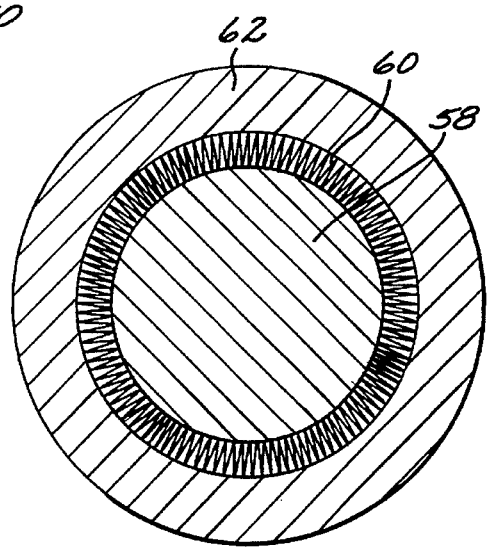
FIG. 6 is a cross-sectional view taken on lines 6,6 of FIG. 5.

FIG. 2 shows a vertical or near vertical section of the drill string 10 where an underwater mateable electrical connector (wet connector or "wet stab") 16 is located and is kept from falling downward into the drill string 10 by an interior ledge 18 in the drill pipe. The wet connector 16 has a lower portion 20 and an upper portion 22 which are removable but readily mate and establish electrical connection with one another when the upper portion 22 is lowered into the drill string 10. The lower portion 20 of the wet connector 16 is attached to the wireline 14 leading further downhole. The upper portion 22 is attached electrically and mechanically to a cylindrical weight 24. The weight or sinker bar 24 usually weighs between 20 to 60 lbs, and its purpose is to facilitate the mating of the female upper portion 22 of the wet connector 16 with the male lower portion 20. In accordance with standard practice in the art, two or more sinker bars may be appropriately connected and attached to one another to create such weight which is considered necessary in any particular downhole application.

Above the sinker bar or weight 24 is located a centralizer 26. The centralizer 26 is a cylindrical body which has three (or more) bow springs 28 mounted symmetrically on its periphery. The bow springs 28 are dimensioned to "grab" the interior of the drill pipe with sufficient force to center the centralizer 26 and the items concentrically attached to it within the interior of the drill pipe. The centralizer 26 shown in FIG. 2 has two sets of bow springs 28, which are connected with one another with a coil spring 30 placed concentrically on the cylindrical centralizer body.

Above the centralizer 26 is located the rotatable electrical connector or swivel 32 of the present invention. Before the rotatable electrical connector or swivel 32 is described in detail, it is noted that electrical contact is maintained between the swivel 32 and the wireline 14 attached to the lower portion 20 of the wet connector 16 through the centralizer 26 and sinker bar 24, in accordance with the state of the art. Generally speaking, the wet connector 16, sinker bar 24, centralizer 26 and other components of the wireline assembly which are described in connection with the present invention, are mechanically connected to one another by threaded connections, and electrically connected to one another by banana plugs and matching female receptacles, using such adapters for mechanical and electric purposes as necessary. These items are well known in the art, and are generally speaking available commercially; Applied Electronics of Broussard, La. for example is a commercial source for cable heads, weight bars and centralizers.

Referring now primarily to FIGS. 3, 4, 5 and 6, the preferred embodiment of the rotatable electrical connector or swivel 32 is described in detail. The first portion of FIG. 4 actually shows a substantially standard, state-of-the-art female connector set 34 the upper end of which is connected to the wireline 14. The lower end of the female connector set 34 includes a standard female thread 36 into which a mandrel 38 is screwed in. O ring seals 40 disposed in circumferential grooves on the mandrel 38 prevent drilling mud or other external fluid (not shown) from entering the interior of the female connector set 34. Generally speaking, all materials utilized in the construction of the present invention are of the type which are suitable for use in downhole equipment, thus capable of withstanding high pressures and elevated temperatures. The O rings and other rubber articles used in the present invention are made, for example, from heat resistant rubber material, known under the trade names VITON or BUNA. The metal parts of the rotatable electrical connector of the invention are, generally speaking, made of stainless steel suitable for use in downhole applications, except for such parts the material of which is specifically described here.

The mandrel 38 extends downwardly from the female connector set 34 and enters a sealed chamber which includes a cylindrical upper housing body 42, sealed on its top with a threaded cap 44. As it is described below, oil suitable for downhole application (for example Capella oil, or Aeroshell Turbine Oil #555 from Shell Oil Co.) fills the chamber under such pressure which is substantially equal to the outside hydrostatic pressure. O rings 40 and rotary seals 46 prevent leakage of fluids from one side of the respective seals to the other side.

The mandrel 38 is rotatably mounted within the housing, by ball bearings 48 and radial bearings 50. A metal spacer 51 is provided between radial bearings 50. A shaft or conductor rod 52 made of highly conductive material, such as bronze, is located concentrically within the hollow mandrel 38. The upper end of the conductor rod 52 is electrically connected within the female connector set 34 with the inner conductor wire (hot wire) of the wireline 14. An insulator tube 53 ending in an insulator collet 54 electrically separates the conductor rod 52 from the mandrel 38. The mandrel 38 includes an enlarged hollow cylindrical head 55 with circumferential grooves into which beryllium copper wiper springs 56 are mounted so as to contact the interior of the housing 42. The role of the wiper springs 56 is described below. A vent hole 57 is incorporated into the cylindrical head 55 to allow passage of oil. The vent hole 57 is shown on FIG. 4 with dashed lines.

The conductor rod 52 terminates in an enlarged cylindrical brass head 58 which forms one mating surface of the electrical connection for the inner conductive wire of the wireline 14. The brass head 58 also has two circumferential grooves into which beryllium copper wiper springs 60 are mounted. The brass head 58 can be considered the rotor of a rotor/stator pair of the rotating electrical contacts in accordance with the present invention. A cup 62, formed of stainless steel, is concentrically aligned on a shaft 64 with the brass head rotor 58, and forms a mating complementary surface therewith. The cup 62 can be considered the stator of the rotor/stator pair, although it should be kept in mind that because the rotation is relative, the designations "rotor" and "stator" within the pair are arbitrary. An insulating piece 66 is disposed on the shaft 64 below the cup/stator 62. Another hollow cylindrical body 68 is disposed below the insulator 66, and there is an insulator tube 70 within the body 68. The insulator tube 70 electrically separates the brass stator 62 and its shaft 64 from the hollow body 68. The chamber or housing containing the lubricating oil is completed by a rubber boot 71 which is mounted on a boot retainer 72 and on an enlarged head portion 73 of the cylindrical body 68, internally screwed into a lower cylindrical housing piece 74. The lower cylindrical housing piece 74 is threadedly attached to the upper housing 42 via element 73, but has a plurality of apertures 76 so as to allow entry of exterior fluid, such as drilling mud (not shown). Entry of the drilling mud into the oil filled chamber, however, is prevented by the rubber boot 71 and a plurality of O rings 40. An oil passage hole 77 is incorporated in the enlarged head portion 73 and is shown by dashed lines in FIG. 4.

The lower end of the stator's shaft 64 protrudes downwardly from the oil filled chamber, and is electrically connected to the electrical coupling contained in the centralizer bar 26 in accordance with the state-of-the-art. This is shown on the bottom part of FIG. 4.

All insulating material used in the rotatable electric connection or swivel 32 of the present invention is of the type normally used for such purpose in downhole drilling equipment, in accordance with the state-of-the-art. A material commercially available under the trade name TORLON is particularly suitable for this purpose. The beryllium copper wiper springs utilized in the invention are available from Bal-Seal Engineering of Santa Ana, Calif.

As it should be readily apparent from the foregoing structural description and inspection of the drawing figures, relative rotation can occur between the mandrel 38 and its enlarged head 55 on the one hand and the upper housing 42 on the other; that is between the mandrel 38 and 55 and the oil filled chamber. The lower housing piece 74 is fixedly attached to and rotates together with the upper housing 42. Relative rotation can also occur between the conductor rod 52 and its head 58 (rotor) on the one hand and the cup 62 stator on the other; that is the conductor rod/rotor 52 and 58 rotate (or stay stationary) with the mandrel 38 and 55 while the cup/stator 62 and its shaft 64 rotate with the housing 42 and lower housing 74. Continuous high quality electric contact on the "hot wire" of the wireline 14, suitable for high speed digital data transmission, is maintained between the rotor 52 and stator 62 through the beryllium copper wiper springs 60 which continuously provide approximately 100 or more electrical contact points between the mating surfaces. Continuous high quality electric contact of the "ground", suitable for high speed digital data transmission, is similarly maintained between the head 55 of the mandrel 38 and the upper housing 42 by the beryllium copper wiper springs 56. The internally rotating parts are lubricated by the oil, which due to the presence of the rubber boot 71 is under the same pressure as the external hydrostatic pressure. Consequently the O rings 40 and the rotary seals 46 of the rotatable electric connector 32 experience approximately the same pressure on both sides, and provide an adequate useful life. The herein described preferred embodiment also avoids relative rotation of parts directly in contact with the rubber boot 71, and therefore avoids potential sources of leakage of drilling mud into the oil chamber.

As it should be further apparent from the foregoing, when during a drilling operation the drill string 10 is rotated from the surface then that portion of the wireline 14 which is below the swivel 32 rotates together with the drill string 10. This is because the centralizer bar 26 rotationally anchors the wireline 14 to the drill string 10. The upper portion of the wireline 14 starting from the conductor rod 52 in the swivel 32, together with the mandrel 38 and all couplings above it, however remain stationary in spite of the fact that drill pipe surrounding the upper portion of the wireline 14 rotates around it. As it was noted in the introductory section, this permits continuous operation and high speed date transmission through wireline of instruments, such as surveying and steering, Γ ray counting, chlorine logging electrical resistivity sensing, weight-on-bit measuring tools, tachometer for a drill motor and the like.

The swivel 32 of the present invention can also be used, with equally good results, in a position which is vertically reversed from the position described above. When the swivel 32 is used in this manner, the mandrel 38 extends downwardly from the swivel 32 in the downhole direction. Inasmuch as the connectors and other components which are attached to the swivel 32 of the invention are substantially standard in accordance with the state-of-the-art, further description of connecting the swivel 32 within the "wireline string" in a position reverse to the one described above is not necessary.

Several modifications of the present invention may become apparent to those skilled in the art in light of the foregoing disclosure. Therefore, the scope of the present invention should be interpreted solely from the following claims, as such claims are read in light of the disclosure.

What is claimed is:

1. A rotatable electric connector to be used on a single conductor wireline used in connection with subterranean drilling, the rotatable electric connector comprising:

a housing enclosing a chamber;

lubricating oil contained in the chamber;

a first shaft concentrically mounted in the housing and protruding therefrom, and connectable to one end of the wireline;

a first member concentrically aligned with and attached to the first shaft;

a second member concentrically aligned with the first member, the first and second members having matching rotationally complementary surfaces, said first and second members being immersed in the lubricating oil;

a second shaft concentrically aligned with and attached to the second member, one of the first and second shafts being rotatably mounted in the housing in bearings, the second shaft protruding from the housing and connectable to the other end of the wireline;

at least one conductive wire spring wiper disposed circumferentially on one of the first and second members in contact with the complementary surfaces of the first and second members immersed in the lubricating oil and forming electrical contact between the rotationally complementary surfaces; and means for equalizing the pressure of the lubricating oil in the housing with external pressure outside of the housing.

2. The rotatable electric connector of claim 1 wherein the wire spring wiper consists essentially of beryllium copper alloy.

3. The rotatable electric connector of claim 1 comprising a plurality of conductive wire spring wipers disposed circumferentially on one of the first and second members in contact with the complementary surfaces of the first and second members.

4. The rotatable electric connector of claim 1 wherein the first shaft is rotatably mounted in the housing, and where the first member is substantially configured in the shape of a cylinder, the second member is substantially configured in the shape of a cup which at least partially encloses said cylinder, and wherein a plurality of wire spring wipers are disposed around the circumference of the cylinder and are in contact with exterior surface of the cylinder and with the interior surface of the cup.

5. The rotatable electric connector of claim 1 further comprising a hollow mandrel which is disposed partially within the housing, is rotatably mounted within the housing, the first shaft being disposed in the interior of the mandrel and being electrically insulated therefrom, and at least one conductive wire spring wiper disposed between the housing and the mandrel establishing and maintaining electrical contact between the mandrel and the housing.

6. The rotatable electric connector of claim 5 further comprising a rotary seal disposed between the mandrel and the housing, the rotary seal acting as means for preventing entry of drilling fluid into the interior of the housing.

7. The rotatable electric connector of claim 6 comprising at least two conductive wire spring wiper disposed circumferentially on one of the first and second members in contact with the complementary surfaces of the first and second members immersed in the lubricating oil and forming electrical contact between the rotationally complementary surfaces, and at least two conductive wire spring wipers disposed between the housing and the mandrel establishing and maintaining electrical contact between the mandrel and the housing.

8. The rotatable electric connector of claim 7 wherein all wire spring wipers consist essentially of beryllium copper alloy.

9. A rotatable electric connector to be used on a wireline having an internal hot wire and an external ground, used in connection with subterranean drilling, the rotatable electric connector comprising:

a housing enclosing a chamber;

lubricating oil contained in the chamber;

a first shaft rotatably mounted in the housing on bearings and protruding therefrom, the first shaft being connectable to the hot wire of the wireline;

first member concentrically aligned with and attached to the first shaft;

a second member concentrically aligned with the first member, the first and second members having matching rotationally complementary surfaces, said first and second members being immersed in the lubricating oil;

a second shaft concentrically aligned with and attached to the second member, the second shaft protruding from the housing and connectable to the hot wire of the wireline;

at least one conductive wire spring wiper disposed circumferentially on one of the first and second members in contact with the complementary surfaces of the first and second members immersed in the lubricating oil and forming electrical contact between the rotationally complementary surfaces thereby forming a rotatable electric connection for the hot wire of the wireline;

a hollow mandrel which is disposed partially within the housing, and is rotatably mounted within the housing, the first shaft being disposed in the interior of the mandrel and electrically insulated therefrom;

at least one conductive wire spring wiper disposed between the housing and the mandrel establishing and maintaining electrical contact between the mandrel and the housing thereby forming a rotatable electric connection for the ground of the wireline, and means for equalizing the pressure of the lubricating oil in the housing with external pressure outside of the housing.

10. The rotatable electric connector of claim 9 where the first member is substantially configured in the shape of a cylinder, the second member is substantially configured in the shape of a cup which at least partially encloses said cylinder, and wherein a plurality of wire spring wipers are disposed around the circumference of the cylinder and are in contact with exterior surface of the cylinder and with the interior surface of the cup.

11. The rotatable electric connector of claim 10 comprising a plurality of conductive wire spring wipers disposed between the mandrel and the housing.

12. The rotatable electric connector of claim 11 wherein the wire spring wipers consist essentially of beryllium copper alloy.

13. The rotatable electric connector of claim 12 further comprising a rotary seal disposed between the mandrel and the housing, the rotary seal acting as means for preventing entry of drilling fluid into the interior of the housing.

14. The rotatable electric connector of claim 13 wherein the means for equalizing the pressure comprises a membrane of rubber which forms part of the housing.

15. A process for conducting a measuring or data collecting operation downhole in a bore hole with a drill string comprising drill pipes used for subterranean drilling, which process comprises:

collecting data by an instrument located downhole within the drill string, transmitting electric signals corresponding to the data to a receiving instrument on the surface on a single conductor wireline which is contained within the drill string and which interconnects the downhole instrument with the surface instrument, in between the downhole location and the surface, the wireline including an electric connector comprising a rotor and a stator which rotate with respect to one another during the rotation of the drill string, and through which the electric signals corresponding to the data are transmitted, the wireline at one of its ends attached to the rotor for being rotationally anchored to the drill string and the wireline at its other end attached to the stator for being capable of staying stationary when the drill string rotates, and rotating the drill string from the surface while the electric signals corresponding to the data are transmitted on the wireline and through the connector.

* * * * *